United States Patent [19]

Brenner et al.

[11] Patent Number: 4,784,666

[45] Date of Patent: Nov. 15, 1988

[54] HIGH PERFORMANCE WASHING PROCESS FOR VERTICAL AXIS AUTOMATIC WASHER

[75] Inventors: Robert A. Brenner, St. Joseph Township, Berrien County; Anthony H. Hardaway, Lincoln Township, Berrien County, both of Mich.

[73] Assignee: Whirlpool Corporation, Benton Harbor, Mich.

[21] Appl. No.: 894,813

[22] Filed: Aug. 8, 1986

[51] Int. Cl.[4] ..... D06M 1/16

[52] U.S. Cl. ..... 8/137

[58] Field of Search ..... 8/137, 158, 159, 95, 8/174.12

[56] References Cited

U.S. PATENT DOCUMENTS

| | | | |
|---|---|---|---|
| 1,234,498 | 7/1917 | Seymour, Jr. . | |
| 2,584,833 | 2/1952 | Beucler . | |
| 2,630,001 | 3/1953 | Criner . | |
| 2,883,843 | 4/1959 | Bochan . | |
| 3,197,980 | 8/1965 | Marple . | |
| 3,302,433 | 2/1967 | Nallinger . | |
| 3,387,310 | 6/1968 | Marshall | 8/158 |
| 3,388,410 | 6/1968 | Marshall . | |
| 3,647,354 | 3/1972 | Loeb . | |
| 3,650,673 | 3/1972 | Ehner . | |
| 3,740,975 | 6/1973 | Cornellius . | |
| 3,811,300 | 5/1974 | Barton et al. . | |
| 4,087,368 | 5/1978 | Borrello | 252/89 |
| 4,225,992 | 10/1980 | Morey . | |
| 4,489,455 | 12/1984 | Spendel . | |
| 4,489,574 | 12/1984 | Spendel | 8/159 |

OTHER PUBLICATIONS

GE Offers Anti-Stain System In Home Furnishings Magazine-Published Mar. 18, 1985.

GE Owner's Manual for WWA8500G Automatic Washer.

*Primary Examiner*—Paul Lieberman

*Assistant Examiner*—John F. McNally

*Attorney, Agent, or Firm*—Hill, Van Santen, Steadman & Simpson

[57] ABSTRACT

A method for laundering a textile wash load is provided for use in a vertical axis washing machine in which a concentrated detergent solution containing a detergent concentration of 0.5% to 4% by weight is continuously applied to a spinning wash load for a predetermined time period to thouroughly wet the clothes load. The amount of detergent solution used is only slightly in excess of the amount required to saturate the clothes load at the given rotational speed. After the time period, additional water is added to the solution to dilute it to a normal concentration and then mechanical agitation and rinsing steps are conducted to complete the wash cycle.

14 Claims, 3 Drawing Sheets

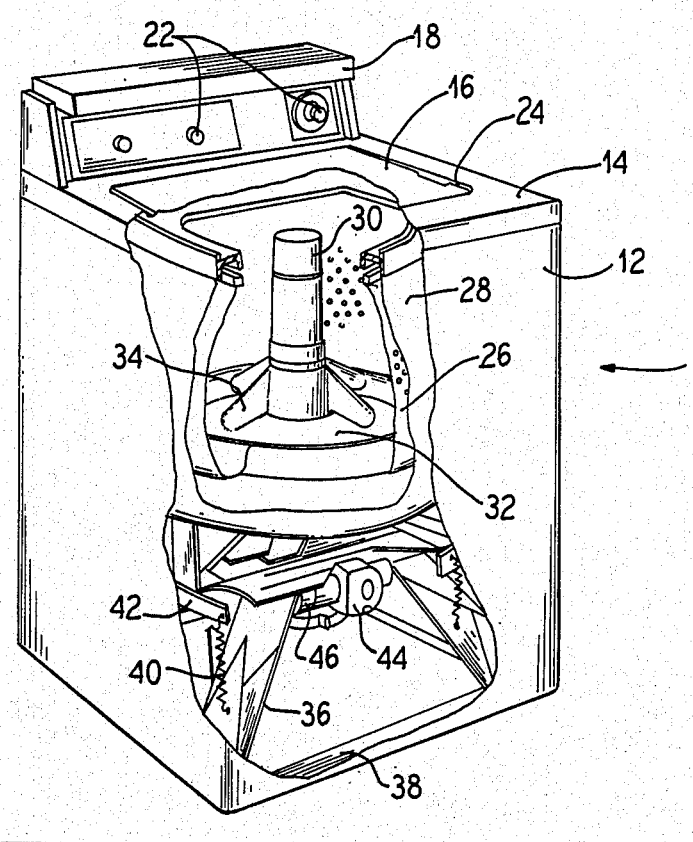
FIG. 1
FIG. 3
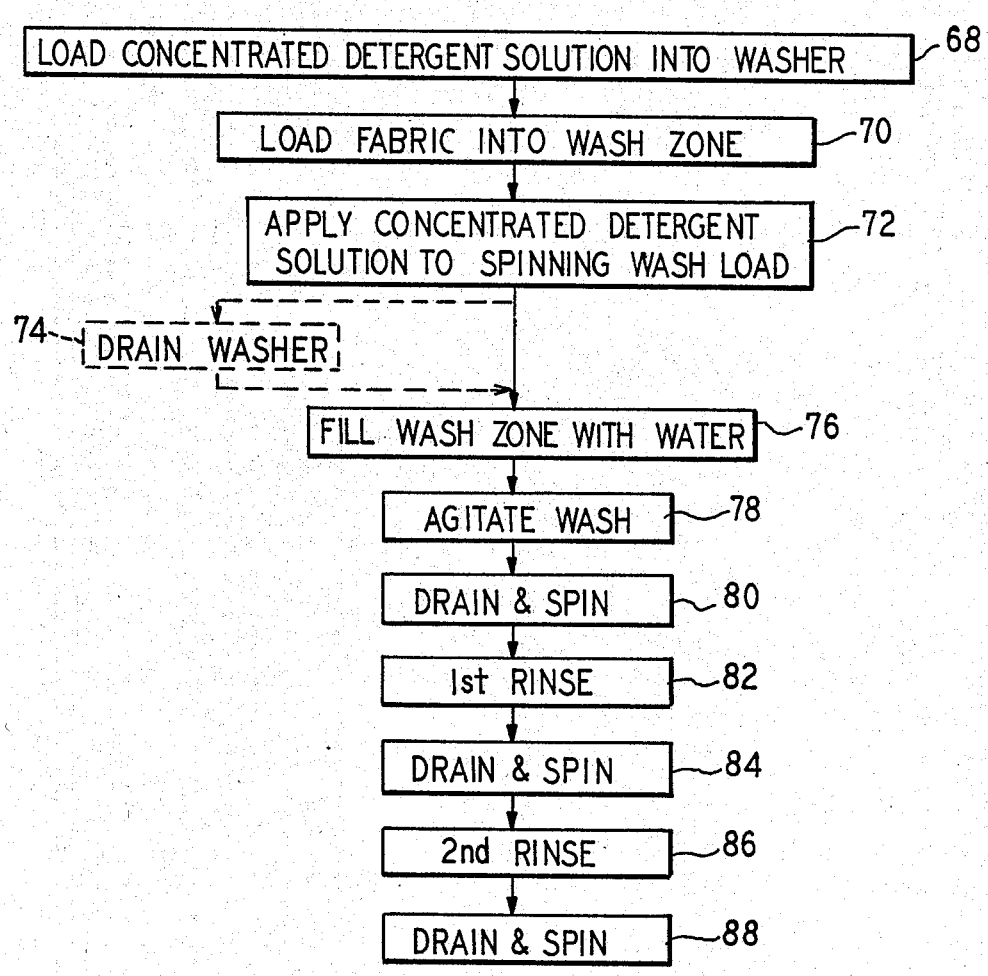

HIGH PERFORMANCE WASHING PROCESS FOR VERTICAL AXIS AUTOMATIC WASHER

BACKGROUND OF THE INVENTION

1. Field of the Invention

The present invention relates to a method of washing clothing articles and, more particularly, to a high performance method of washing clothing articles in a vertical axis automatic washer that includes a concentrated detergent solution washing operation.

2. Description of the Prior Art

Prior art washing machines use various different methods for washing clothes loads but, in general, all methods utilize varying amounts of mechanical, chemical, and thermal energy to remove soil from the fabric. Many machines employ an agitator that is mounted on a vertical axis and driven in an oscillating rotary fashion to agitate the clothes load in the presence of a detergent solution. After a predetermined period of agitation, such a wash cycle is typically followed with a rinse cycle. By way of example, conventional methods for washing a six pound "normal" load of mixed cotton and polyester fabric in a vertical axis washer typically include twelve to fourteen minutes of agitation in a wash bath having a volume of about 64 liters of water, resulting in a water to cloth ratio of approximately twenty-four to one (by weight). Detergent concentrations within the range of 0.06% to 0.28% are typically used during such washing operations, the detergent concentration being defined as the percent by weight of detergent for unit volume of water.

Some prior art wash methods wash the clothes load in a concentrated detergent solution for the purpose of enhancing soil removal or reducing the amount of water consumed during the washing operation. Such concentrated wash methods have been most commonly employed on horizontal axis washing machines which provide mechanical agitation of the clothes load by tumbling the load during the concentrated washing operation. U.S. Pat. No. 4,489,574 describes such a concentrated wash process. One prior art method is known for conducting a concentrated washing operation in a vertical axis washer of the type disclosed in U.S. Pat. No. 4,225,992. This process is, however, limited to small wash loads and requires the use of a separate, auxiliary wash basket.

The known prior art wash methods, whether practiced in a horizontal axis or a vertical axis machine, employ varying amounts of mechanical agitation of the clothes load. That is, during the concentrated washing operation the individual items of clothing are moved relative to each other and relative to the wash basket or drum. While such agitation of the clothes load is generally desirable in achieving good soil removal, agitation of the clothes load is also known to cause various types of fabric damage. The amount of fabric damage that occurs during a washing operation is a function of many variables, including the duration and type of agitation provided, the type of fabric being washed, and the amount of water in the wash bath. The damage most commonly experienced includes abrasion, pilling, and deformation due to stretching, tangling, etc.

SUMMARY OF THE INVENTION

The applicants have found that the extent of mechanical agitation imparted to the clothes load and the water to cloth ratio are important parameters when attempting to achieve good washing performance in a vertical axis concentrated washing process. By way of example, for vertical axis washing processes which impart mechanical agitation to the clothes load, as the water to cloth ratio is decreased from the conventional level of approximately twenty-four to one, as by decreasing the amount of water in the wash bath, the amount of soil redeposited on the clothes load tends to increase, even where very high detergent concentrations, such as one percent, are used. In particular, soil redeposition was found to reach an unacceptable level when the water to cloth ratio had been reduced to five to one.

The applicants have, however, discovered a concentrated washing operation that can be successfully practiced in a vertical axis automatic washer at water to cloth ratios well below five to one, through the use of a concentrated spin-wash operation which does not involve mechanical agitation of the clothes load.

The applicants have further discovered a high performance washing method which can be viewed as a sequential combination of a concentrated washing operation using a low water to cloth ratio, in which the clothes are spun in the wash basket while a concentrated detergent solution is sprayed on the clothes and recirculated, with a second washing operation during which the basket is substantially filled with water and mechanical agitation is applied to the clothes load. Very little water is required during the concentrated washing step, and no mechanical agitation is applied to the clothes during this operation. That is, the clothes do not move relative to each other during the concentrated wash step, even though they are being spun about the vertical axis of the machine.

It has been found that an amount of detergent solution only slightly in excess of that required to saturate the clothes load is sufficient for the concentrated washing operation. The excess detergent solution is collected and recirculated back onto the clothes load, and the amount of excess solution required is determined by the design of the pump, the fluid circulation system, and the type of fabric being washed.

The tub and basket may or may not be drained after the concentrated washing operation. In either case, the detergent remaining after the concentrated washing operation can also be used, after dilution by a fill operation, for the second washing operation. This fill operation is similar to a rinse operation since only water is added, not additional detergent. However, since detergent either remains in the washer in the concentrated solution or absorbed in the clothes, applicants define this next step as a washing operation because additional soil removal action occurs during mechanical agitation in the presence of a relatively normal detergent solution concentration.

Various means can be used to deliver the concentrated washing solution to the clothes load. By way of example, a nozzle or spray head located adjacent to the top basket opening can be used to direct the liquid onto the clothes load as it spins. Alternatively, an agitator having means for spraying the washing solution and on to the clothes load may be used. Both types of structures are known in the art, and the improved wash method can thus be practiced with a washing machine that is of essentially conventional construction.

It has been determined that, contrary to the teachings of prior art concentrated wash methods, uniform washability can be achieved without the need for pre-wetting the clothes load or redistributing the clothes load during the concentrated washing operation.

While it is possible to wash a clothes load using either the applicants' concentrated washing operation or a conventional washing operation (employing mechanical agitation) alone, it has been determined that neither operation alone provides the level of performance that can be attained by combining these operations. This is particularly true when the clothes are being washed in very hard water, or in cold water, that is water of room temperature (approximately 20° C.). Thus, it is an object of the invention to provide an improved washing cycle for use in a conventional vertical axis automatic washer which:

(A) Uses little or no hot water, thereby providing an energy savings since the water temperature does not have to be increased to achieve a high degree of washability, also this provides an advantage in washing permanent press clothes since the wash water can be kept below the temperature at which the permanent press resin sets;

(B) Provides improved washability where very hard water is used (without requiring additional detergent or water softeners or conditioners);

(C) Provides improved washability for certain fabrics, such as polyester;

(D) Requires no more total water (and can use less) than a conventional "regular" wash cycle in a vertical axis washer;

(E) Reduces the amount of mechanical agitation required to obtain high levels of washability, thereby reducing the potential for fabric damage and making the cycle truly usable for all washable types of fabric; and (F) Can be practiced in a conventional vertical axis automatic washer, for any load size, without the use of special accessories.

In sum, the method of the present invention is much less sensitive to the type of detergent used, the temperature of the wash water, and the hardness of the wash water than a conventional washing cycle. This permits very good performance to be obtained under a very wide variety of conditions, thus making the washing machine significantly easier to use.

The present inventive method can also be used obtain good washability of garments that are lighter than water (such as down jackets, etc.) which tend to float on top of the water, and are therefore difficult to launder using a conventional vertical axis wash method.

The present invention is believed to have the following novel aspects over the prior art.

1. The use of a vertical axis washer to conduct a concentrated washing operation which does not provide mechanical agitation of the clothes load during the concentrated spin washing operation.

2. The use of a concentrated "spin wash" in a vertical axis automatic washer.

3. The use of a concentrated "spin wash" in a vertical axis automatic washer where the volume of wash solution is used is only slightly in excess of the amount retained by the spinning clothes load, to permit recirculation and reapplication of the wash solution 4. The use of a concentrated, low water volume "spin wash" in which the clothes load need not be redistributed or otherwise agitated during the concentrated wash step.

5. The sequential combination of a concentrated "spin wash" with an "agitate wash" (normal water level, mechanical agitation) in a wash cycle for a vertical axis automatic washer.

6. A washing process which is performed in a concentrated, low water volume spin wash, and in which the basket is subsequently filled with water to a normal level to dilute detergent to approximately normal concentration and then to provide a conventional agitation.

BRIEF DESCRIPTION OF THE DRAWINGS

FIG. 1 is a perspective view of a vertical axis washer partially cut away in which the inventive method can be practiced

FIG. 3 is a chart which describes a representative wash cycle embodying the steps of the present inventive method.

DESCRIPTION OF THE PREFERRED EMBODIMENT

Figure 2:
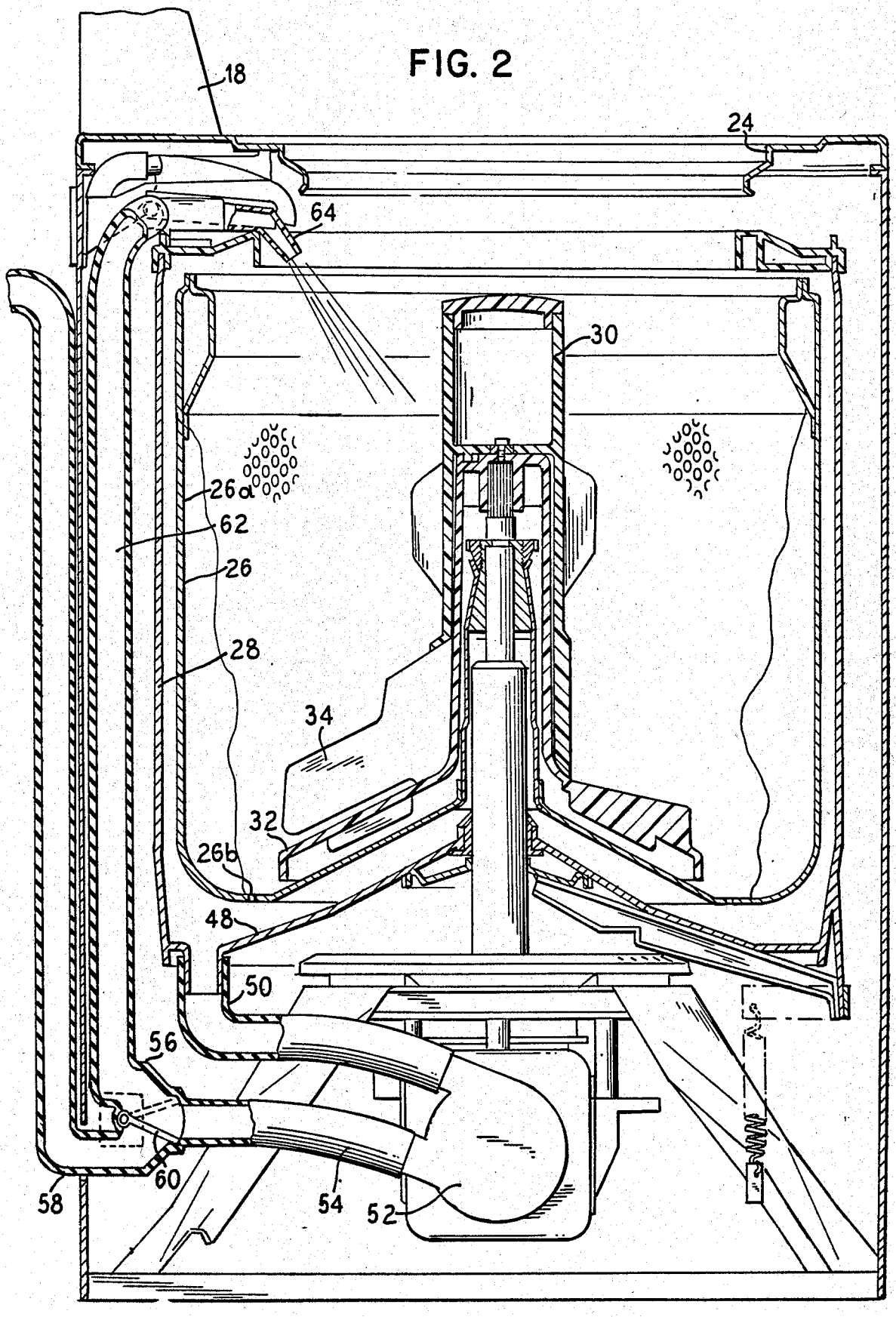
FIG. 2 is a side sectional view through the interior of the washer.

In FIG. 1 there is illustrated an automatic washing machine generally at 10 having an exterior cabinet 12 with a top cabinet panel 14 and an openable lid 16 thereon. A control console 18 has a plurality of controls 22 to operate the washer through a series of washing, rinsing and fluid extraction steps. The openable lid 16 provides access to a top opening 24 through which a load of clothes can be placed into a perforate basket 26 which is concentrically carried within an imperforate tub 28. A vertical axis agitator 30 of conventional design is provided in the wash basket to provide mechanical agitation to the clothes load. The agitator has a bottom skirt portion 32 and a plurality of radially extending vanes 34. The tub and basket assembly is supported by a conventional suspension system, including a plurality of legs 36, which are secured to a bottom frame 38. Counterbalancing means 40 are secured between the legs 36 and another portion 42 of the suspension system. An electric motor 44 operates through a transmission 46 to drive the basket 26 in a rotary motion as well as the agitator 30 in an oscillatory motion.

FIG. 2 shows the interior of the washer in greater detail in which it is seen that there is a sump 48 positioned at the bottom of the wash tub 28 which connects to an outlet conduit 50. The outlet conduit 50 connects to a pump 52 which is driven by the motor 44. Proceeding from the pump 52 is a conduit 54 which has a Y connection with a first leg 56 and a second leg 58. In the Y connection there is a pivotable valve member 60 which is operated by a solenoid (not shown) to close either the first portion 56 or second portion 58. The second portion 58 extends to a drain for disposal of liquid in that portion and the first portion 56 continues upwardly in a conduit 62 which is connected to a spray head 64 for spraying wash liquid into the interior of the wash basket 26. The spray head is positioned such that the recirculated wash liquid is directed downwardly and laterally in the direction of basket rotation during spin, to thereby cause the spray to extend in a relatively uniform manner from an upper portion **26*a* of the sidewall of basket 26 to a bottom wall 26*b*** of the basket.

The sump 48 of the wash tub should be large enough to contain the total charge of concentrated detergent solution needed during the initial spin wash cycle. Also, the sump should be configured for efficient recapture and recirculation of the relatively small quantity of concentrated detergent solution used in order to minimize the water required in excess of that needed to completely saturate the clothes load during the spin wash process.

FIG. 3 is a chart that illustrates a complete high performance wash cycle suitable for use in laundering a mixed load of cotton, polyester, and cotton-polyester blend fabrics. In step 68 a charge of detergent is loaded into the washer along with a predetermined amount of water to provide a concentrated detergent solution. This concentrated detergent solution should be added directly to the sump 48 and not onto the clothes load. This is done while the basket and agitator remain in a stationary position and preferably before the clothes load is even admitted into the basket. This assures that the sump area will be provided with the full charge of concentrated detergent solution. It has also been found to be desirable to add an anti foaming agent such as SAG 240 manufactured by Union Carbide, especially if soft water or a lightly soiled clothes load is to be washed. Water hardness and presence of soil will reduce the amount of sudsing by themselves.

Step 70 is to load the fabric into the wash zone, that is into the basket 26 where the washing operation occurs. As stated above, this preferably occurs after the detergent and water have been introduced to the sump area so that the detergent will be completely disolved or mixed into a uniform solution rather than being placed directly onto the clothes load.

Step 72 is to apply the concentrated detergent solution to a spinning wash load. This is refered to as the spin wash cycle in that the clothes load is not mechanically agitated, it merely is spun with the wash basket and held by centrifugal force against the basket wall during the spinning while the concentrated solution is applied to the spinning wash load. The application of the solution is done by directing the detergent solution through the spray head 64 which directs the solution against the clothes load held against the basket wall. Preferably, the direction of spray is in the direction of the spinning tub, that is, if the tub is spinning in a clockwise direction the spray is directed laterally toward the wall in that same direction of spin.

The concentrated detergent solution is preferably a volume which is slightly in excess of the saturation level for the clothes load. For the purposes of this specification, saturation is defined as the point at which a load of clothes contains all the liquid it can hold. Adding additional liquid at this point merely causes a like amount of liquid to be discharged from the load. Under this definition, the saturation point varies inversely with spin speed due to liquid removal under the action of centrifugal force. The detergent concentration in the wash liquid should preferably be in the range of 1% to 3% during the spin wash step 72.

Washability tests have been conducted using 420 RPM and 640 RPM spin speeds during the spin wash step. Little difference in performance was observed. However, Applicants believe that the performance of the spin wash would fall off considerably if a very low spin speed was used. A low spin speed would greatly reduce the quantity of detergent solution being passing through the load during a given period of time. It is also believed that forcing the water through the fabric by centrifugal force causes it to take a relatively direct (radial) path through the fabric, as opposed to following a path of least resistance, which would tend to provide non-uniform wetting. The problem of getting uniform wetting of the fabric increases as the amount of wash liquid is decreased. Thus, in order to obtain the use of a higher concentration of detergent in the solution without increasing the actual amount of detergent requires that less water be utilized to arrive at the final solution volume. Since it is desirable to use a low water to cloth ratio it is important that steps be taken to ensure that uniform wetting of the fabric occurs.

It has been found that it is desirable during the spin wash step 72 to recirculate and reapply the concentrated detergent solution against the clothes load as many times as is possible during a given time period which enhances and assures complete wetting of the clothes load. Thus, spin speeds in the range of 420–640 RPM are desirable in order to cause the detergent solution to quickly and directly pass through the clothes load to be recaptured in the sump area and recirculated and resprayed on to the clothes load.

It has also been determined by the Applicant that some washing, that is soil removal, is taking place during the spin wash step, so recirculation of the detergent solution several times through the load is desirable. It appears that during this step of the wash cycle there is a chemical cleaning action occurring during which time the bonds holding the soil to the fabric are broken or weakened chemically without the flexing action of a mechanical agitation step. Also, since a relatively normal amount of detergent is placed into an abnormally low amount of wash water, the amount of detergent required to chemically soften the water is less, and therefore more of the detergent is available for the chemical cleaning action.

It is also within the scope of the present invention to apply a continuously fresh concentrated detergent solution to the spinning wash load and to direct the concentrated solution which has been discharged from the clothes load directly to drain rather than recirculating the same solution repeatedly through the clothes load. However, the preferred arrangement is to recirculate in order to reduce the amount of water and detergent required.

The concentrated spin wash step 72 continues for a predetermined time period and then the wash basket 26 is brought to a stop. At this point an optional step 74 of draining the washer of the collected concentrated detergent from the sump may occur. There will, of course, be an amount of concentrated solution which has been absorbed into the clothes load which will remain within the washer. This optional draining step merely would reduce the overall amount of detergent remaining in the washer.

The next step would be to fill the wash zone with water as is done in a normal washing cycle which will, in this case, form a more dilute detergent solution. This dilute solution is made up of the original concentrated solution and the new water. Therefore, the original detergent is reused in the dilute solution. Filling the wash zone in this manner results in a detergent solution that corresponds to the normal solution concentrations recommended by the detergent manufacturers for conventional wash operations, that is, in the range of 0.06% to 0.28%.

This filling step 76 is similar to a rinse operation in that the washer would be automatically filling with water to predetermined level to dilute the degree of detergent concentration within the washer. In the present method however the result is different than a rinse operation in that the resulting detergent concentration is a "normal" concentration rather than a more dilute concentration.

In step 78 the wash load is mechanically agitated in the dilute solution of normal concentration similar to a normal washing cycle. It is during this mechanical agitation wash step that the fabric is flexed to further break the bonds between the soil and fabric and to provide a mechanical cleaning of the clothes within the chemical solution as opposed to the primarily chemical soil removal process of the spin wash step. The remainder of the wash cycle incorporates rinsing steps as illustrated in FIG. 3 such as a first drain and spinning step 80 in which most of the soil laden solution is removed from the washer prior to a first spray rinse step 82 in which the solution retained by the fabric load is diluted, followed by a second drain and spin step 84 to again remove the soil and detergent held in solution. A second rinse operation 86 and third drain and spin step 88 serve to virtually completely remove any remaining detergent or soil from the fabric load. As is known, these rinse steps may be spray rinses or deep fill rinse steps as is desired.

The spinning of the wash load during the concentrated is desired. spin wash cycle has been determined to be an important part of the total high performance wash process. From tests it appears that the centrifugal force moving the water through the clothes load during a spin operation provides a more uniform wetting of the load than merely spraying a concentrated solution on a fixed (non-spinning) load. The centrifugal force is also believed to effect a more rapid wetting of the clothes than could be achieved through the use of gravity alone. Also, a more uniform washability level is achieved for a load that has been spun for several minutes with continuous recirculation of the concentrated detergent than for a load which has spun only for a period long enough to wet the fabric, after which the load was brought to rest.

A specific time period which has been found to be acceptable in step 72 is 10 minutes. An acceptable time period for agitation in step 78 is 6 minutes. This time period is substantially less than is acceptable for a conventional agitate only wash cycle which is approximately 12 to 14 or even up to 18 minutes. This provides a distinct advantage of reduced fabric wear during the wash cycle since the amount of flexing of the clothes is reduced. Also, this permits many if not all "washable" fabrics to in fact be washed automatically in the washer rather than being required to be hand washed. The rinse step can either be a conventional deep rinse process or a nonconventional process such as a double rinse process as described.

The amount of water utilized by the complete cycle embodying the principles of the present is no greater and can be less than a conventional wash cycle. For example, an acceptable amount of water required to wash and rinse a 6 pound wash load with the present cycle is 87 liters, while a conventional wash cycle would require 150 liters. Hence a savings in water consumption may also be effected.

The high performance spin wash cycle has been tested through a wide range of various parameters set out in the chart below. The greatest improvement over a conventional cycle has been shown by underlining in specific ranges.

| PARAMETERS | RANGE |
|---|---|
| Water Temp. - Degrees C. | 4–15–26–38–49–60 |
| Water Hardness - PPM | 0–75–150–225–300 |
| Detergent Concentration - % | 0.5–1–2–3–4 |
| Water Volume - Water:Cloth | 1:1–1.75:1–2.5:1–3.25:1–4:1 |
| Detergent Type | PP-NPN-LD-ML-MP |

The designations under detergent type which are indicated as showing greatest improvement over conventional cycle are: phosphate powder (PP); non phosphate (NPN); and multi-functional (MP).

Figure 4:
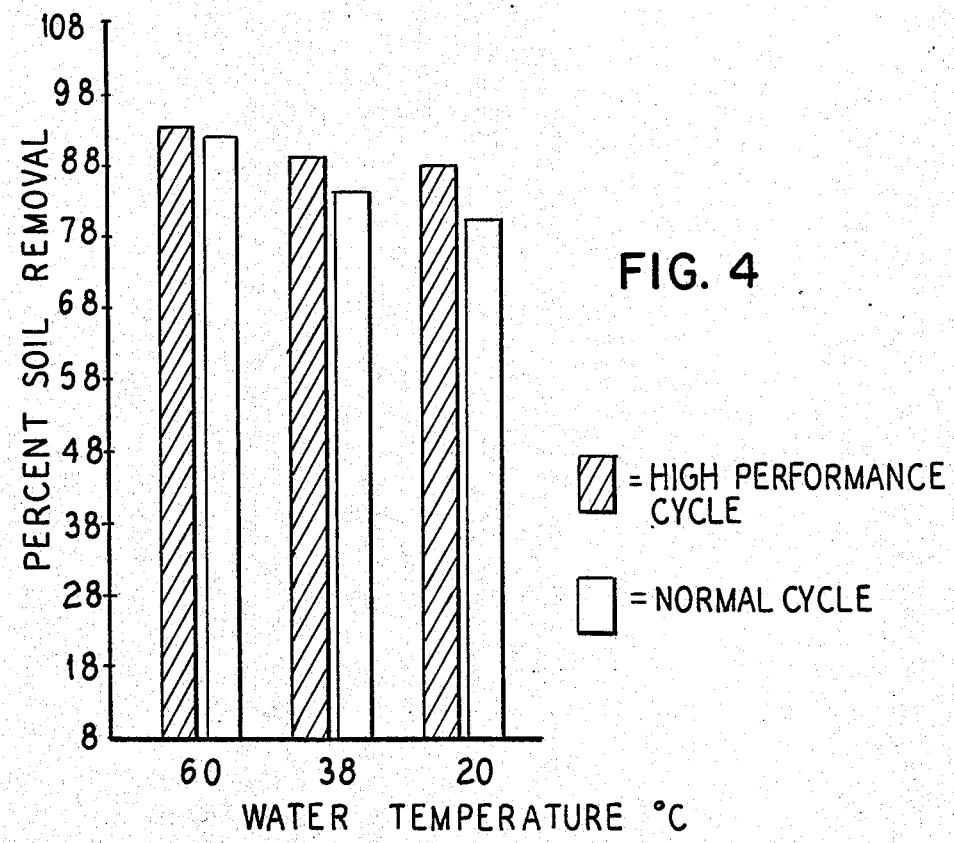
FIG. 4 is a graphic illustration of the test results of the effects of water temperature on soil removal using the present invention.

FIG. 4 is a graphic illustration of empirical tests done to determine the effectiveness of the present wash process under varying water temperatures. The graphs compare a normal wash cycle (conventional detergent concentration and mechanical agitation) with the high performance wash cycle of the present invention (shown by a shaded bar) for each of three water temperatures, 60° C., 38° C. and 20° C. Percent of soil removal in each case for the high performance wash cycle is greater than the normal wash cycle and, as temperature decreases the high performance wash cycle performs increasingly better than the normal wash cycle, with only a slight decrease in performance of the high performance wash cycle across the tested temperature spectrum. As mentioned above, by providing a high degree of washability at a lower temperature, a savings in energy cost can be realized without compromising wash results. In addition to the energy cost savings, an advantage of washing in cooler water is that permanent press clothes will retain their permanent press set longer in that wrinkles will not be set into the clothes above the resin setting temperature.

Figure 5:
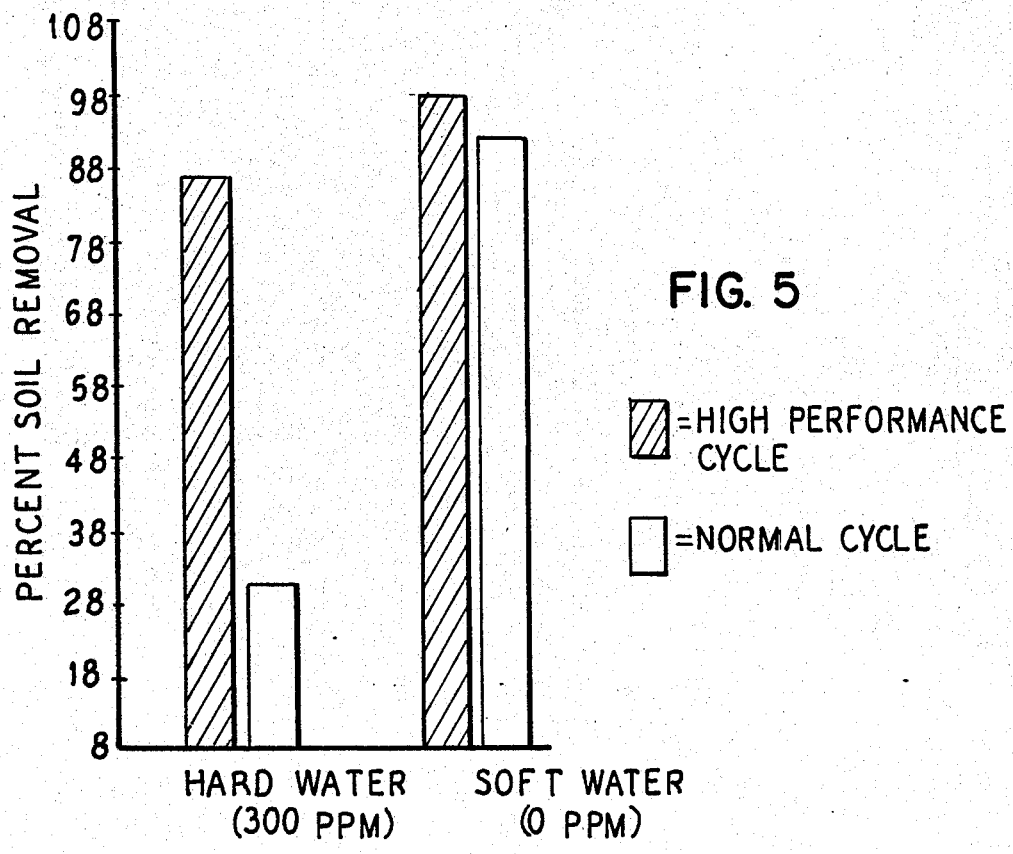
FIG. 5 is a graphic illustration of the test results of the effects of water hardness on soil removal from polyester using the present invention.

FIG. 5 is a graphic illustration of the effects of water hardness on the present wash process and on a conventional wash process. Water hardness is measured by the number of calcium ions in solution. Very hard water may, for example, have a concentration of 300 parts per million; moderately hard water ranges from approximately 60–150 ppm; and soft water ranges from 0–60 ppm. FIG. 5 illustrates two extremes, that is, hard water of 300 ppm and soft water of 0 ppm. As seen in FIG. 5, the high performance cycle of the present invention (shown by a shaded bar) provides greater percentage soil removal than a normal wash cycle for soft water and provides a marked substantially increased percent soil removal over a hard water cycle. Specifically, in soft water the normal percent of soil removal is approximately 85% and with the high performance wash cycle the soil removal approaches 90%. With hard water, the normal cycle removes approximately 24% and the high performance cycle removes nearly 80%. Thus, the present process provides a substantial benefit with respect to hard water washing cycles.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

The embodiments of the invention is which an exclusive property or privilege is claimed are defined as follows:

1. A method of laundering a textile wash load in a washing apparatus having a rotatable wash zone including a peripheral wall, means for rotating said peripheral wall and said wash load in said wash zone about a generally vertical axis, and means for proving mechanical agitation to said wash load within said wash zone, comprising the steps of:

(1) introducing said textile wash load into said wash zone;

(2) rotating said wash load and said peripheral wall at of speed that is sufficient to maintain the load against the peripheral wall;

(3) continuously passing delivering a concentrated detergent solution in the range of not less than approximately 0.5% to 4% detergent concentration through said spinning wash load in the absence of mechanical agitation of said wash load during at least a portion of the time said load is being spun so that the total effective amount passed through is greater than the amount necessary to saturate the clothes load;

(4) terminating steps 2, and 3 after a first predetermined time period;

(5) introducing water to said wash zone to dilute the detergent solution;

(6) agitating the load in the dilute detergent solution for a second predetermined period; and (7) rinsing said detergent solution from said clothes load.

2. A method of laundering a textile wash load in a washing apparatus having a rotatable wash zone including a peripheral wall, means for rotating said peripheral wall and said wash load in said wash zone about a generally vertical axis, and means for providing mechanical agitation to said wash load within said wash zone, comprising the steps of:

(1) introducing said textile wash load into said wash zone;

(2) rotating said wash load and said peripheral wall at a speed that is sufficient to maintain the load against the peripheral wall;

(3) applying and recirculating to said spinning wash load a plurality of times in the absence of mechanical agitation, of said wash load a quantity of detergent solution being only slightly in excess of the amount retained by the spinning wash load and having a detergent concentration within the range of 0.5% to 4% by weight;

(4) terminating steps 2 and 3 after a first predetermined time period;

(5) introducing water to said wash zone to dilute the detergent solution;

(6) agitating the load in the dilute detergent solution for a second predetermined period; and (7) rinsing said detergent solution from said clothes load.

3. The method of claim 2, wherein step (5) results in a detergent solution which has a concentration of 0.06% to 0.28% by weight.

4. A method of laundering a textile wash load in a washing apparatus having a rotatable wash zone including a peripheral wall, means for rotating said peripheral wall and said wash load in said wash zone about a generally vertical axis, and means for providing mechanical agitation to a wash load within said wash zone comprising the steps of:

(1) introducing said textile wash load into said wash zone;

(2) disolving a quantity of detergent into a minimal quantity of water to form a concentrated detergent solution in the range of not less than approximately 0.5% to 4% detergent concentration in an amount in excess of that required to saturate the wash load;

(3) rotating said wash load and said peripheral wall at a speed that is sufficient to maintain the load against the peripheral wall;

(4) applying said detergent solution to said spinning wash load;

(5) recirculating said concentrated detergent solution through said spinning wash load a plurality of times to substantially permeate said wash load without mechanically agitating said wash load;

(6) terminating step 5 after a first predetermined time period;

(7) dispensing water into said wash zone to establish a diluted detergent solution;

(8) agitating said wash load in said diluted detergent solution for a second predetermined period; and (9) rinsing said detergent solution from said wash load.

5. The method of claim 4, wherein step (7) results in a detergent solution which has a concentration of 0.06% to 0.28% by weight.

6. A method of laundering a textile wash load in a washing apparatus having a wash zone and means for providing mechanical agitation to a wash load within said wash zone comprising the steps of:

(1) introducing said textile wash load into said wash zone;

(2) applying and recirculating to said wash load, for a first predetermined time period, a quantity of detergent solution being only slightly in excess of the amount retained by the wash load and having a detergent concentration within the range of not less than 0.5% to 4% by weight without mechanical agitation of said wash load but while imparting a continuous centrifugal force to said wash load to cause said detergent solution to pass through said clothes load a plurality of times;

(3) introducing water to said wash zone to dilute the detergent solution;

(4) agitating the wash load in the dilute detergent solution for a second predetermined period; and (5) rinsing said detergent solution from said wash load.

7. The method of claim 6, wherein step (3) results in a detergent solution which has a concentration of 0.06% to 0.28% by weight.

8. A method of effecting a concentrated centrifugal washing process in a vertical axis automatic washer of the type having a washing zone and presettable control means whereby a batch of articles to be laundered may be automatically cycled through a program of preselected series of washing, rinsing and drying steps which includes the steps of:

(1) charging said washing zone with a predetermined quantum of articles to be laundered;

(2) introducing a concentrated detergent solution in the range of not less than approximately 0.5% to 4% detergent concentration onto said articles in a quantity sufficient to wet the articles to saturation;

(3) centrifugally spinning the articles in the zone to release a portion of said quantity of concentrated detergent solution from the articles while continuing to introduce the concentrated detergent solution onto said articles so that the total effective amount introduced onto said articles is greater than the amount necessary to saturate said articles, all in the absence of mechanical agitation of said articles; and (4) thereafter cycling the articles through a series of steps by which concentration of the detergent solution is reduced and rinsed from said articles.

9. The method of claim 8, wherein step (4) includes a step of filling said washing zone with a quantity of water sufficient to produce a detergent concentration of less than 1% by weight.

10. The method of claim 9, wherein step (3) is performed while simultaneously recirculating the released detergent solution through the spinning articles for a predetermined period of time in the order of about one to ten minutes.

11. A method of laundering a textile wash load in a washing apparatus having a rotatable wash zone including a peripheral wall, means for rotating said peripheral wall and said wash load in said wash zone about a generally vertical axis, and means for providing mechanical agitation to said wash load within said wash zone, comprising the steps of:

(1) introducing said textile wash load into said wash zone;

(2) rotating said wash load and said peripheral wall at a speed that is sufficient to maintain the load against the peripheral wall;

(3) delivering a concentrated detergent solution in the range of not less than approximately 0.5% to 4% detergent concentration onto said load during at least a portion of the time during which said wash load is spun in an amount sufficient to permeate the entire load a number of times, yet without mechanical agitation of the wash load; and (4) thereafter rinsing said detergent solution from said wash load.

12. A method of laundering a textile wash load in a washing apparatus having a rotatable wash zone including a peripheral wall, means for rotating said peripheral wall and said wash load in said wash zone about a generally vertical axis, and means for providing mechanical agitation to said wash load within said wash zone, comprising the steps of:

(1) introducing said textile wash load into said wash zone;

(2) rotating said wash load and said peripheral wall at a speed that is sufficient to maintain the load against the peripheral wall;

(3) delivering a volume of a concentrated detergent solution in the range of not less than approximately 0.5% to 4% detergent concentration onto said load during at least a portion of the time during which said wash load is spun in an amount sufficient to saturate said wash load without mechanical agitation of said wash load;

(4) delivering concentrated detergent solution to said wash load in excess of the amount required to saturate said wash load while at the same time extracting the excessive amount of detergent solution from the wash load, all in the absence of mechanical agitation; and (5) thereafter rinsing said detergent solution from said wash load.

13. A method of laundering a textile wash load in a washing apparatus having a rotatable wash zone including a peripheral wall, means for rotating said peripheral wall and said wash load in said wash zone about a generally vertical axis, and means for providing agitation to said wash load within said wash zone, comprising the steps of:

(1) introducing said wash load into said wash zone;

(2) passing an amount of detergent solution through said wash load in excess of that necessary to saturate the wash load without mechanically agitating said wash load;

(3) thereafter rinsing said detergent solution from said wash load.

14. A method of laundering a textile wash load as recited in claim 13 wherein said wash load is agitated for a time within said wash zone during said rinsing.

* * * * *